US007383608B2

(12) United States Patent
Odachi et al.

(10) Patent No.: US 7,383,608 B2
(45) Date of Patent: Jun. 10, 2008

(54) VACUUM-CLEANER SUCTION TOOL AND VACUUM CLEANER USING THE SAME

(75) Inventors: Toru Odachi, Shiga (JP); Hideo Okubo, Shiga (JP); Saburo Kajikawa, Shiga (JP); Tetsuo Imai, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 777 days.

(21) Appl. No.: 10/421,733

(22) Filed: Apr. 24, 2003

(65) Prior Publication Data

US 2004/0020005 A1 Feb. 5, 2004

(30) Foreign Application Priority Data

Apr. 25, 2002 (JP) ..... 2002-123999
Sep. 13, 2002 (JP) ..... 2002-268570

(51) Int. Cl.
*A47L 9/00* (2006.01)

(52) U.S. Cl. ..... 15/410; 15/361

(58) Field of Classification Search ..... 15/300.1, 15/361, 363, 410
See application file for complete search history.

(56) References Cited

U.S. PATENT DOCUMENTS 6,345,408 B1 * 2/2002 Nagai et al. ..... 15/361
6,473,934 B2 * 11/2002 Lijzenga ..... 15/373
6,574,827 B2 * 6/2003 Hashizume et al. ..... 15/339
2005/0055798 A1 * 3/2005 Bagwell et al. ..... 15/415.1

FOREIGN PATENT DOCUMENTS

JP 2002-102125 4/2002

* cited by examiner

*Primary Examiner*—David A Redding
(74) *Attorney, Agent, or Firm*—Wenderoth, Lind & Ponack, L.L.P.

(57) ABSTRACT

A vacuum-cleaner suction tool includes a sucking portion for sucking up dust on a surface to be cleaned, a joint portion having one end connected to the upper side of the sucking portion and the other end provided with a connection pipe, and an agitator disposed within the sucking portion for scraping dust off the surface. The opening, the joint portion, and the connection pipe each have a channel portion allowing sucked-up dust to pass therethrough. The joint portion is configured to be turnable, relative to the sucking portion, in a horizontal direction substantially parallel to the surface to be cleaned to such an extent that the longitudinal central axis of the sucking portion becomes substantially parallel to the longitudinal central axis of the connection pipe, whereby the forward end of the sucking portion, from left to right, can be brought into close contact with wall surfaces so that dust liable to collect in corners can be fully sucked up.

24 Claims, 12 Drawing Sheets

VACUUM-CLEANER SUCTION TOOL AND VACUUM CLEANER USING THE SAME

FIELD OF THE INVENTION

The present invention relates generally to an overall structure of an electric vacuum cleaner, and more particularly to an improvement in usability of a suction tool used in the vacuum cleaner.

BACKGROUND OF THE INVENTION

A structure of conventional suction tool 1 will be described with reference to FIG. 14A and FIG. 14B. As disclosed in Japanese Patent Unexamined Publication No. 2002-102125, by operating handle 16 to apply turning forces thereto in leftward and rightward directions, suction tool 1 attached to the front end of handle 16 is turned around and brought from the state as shown in FIG. 14A into the state longitudinally oriented as shown in FIG. 14B, when viewed from the position of the user doing cleaning with handle 16 held in hand. Therefore, it becomes possible to advance suction tool 1 into a narrow space or to make cleaning at a portion close to a side wall.

At a position somewhat rearward from sucking portion 4, there is provided supporting portion 7 formed of a roller and the like for keeping sucking portion 4 parallel to the surface to be cleaned while suction tool 1 is moved back and forth.

In the described conventional configuration, however, because the turning center of sucking portion 4 is greatly deviated from the center of sucking portion 4 and also because supporting portion 7 described above is needed to be provided at the rear of sucking portion 4, the width of suction tool 1 becomes great when it is oriented in the longitudinal direction and, hence, it has been only the front portion of suction tool 1 that is then reachable into a narrow space.

SUMMARY OF THE INVENTION

A vacuum-cleaner suction tool is provided which comprises a sucking portion having an opening for sucking up dust on a surface to be cleaned, a joint portion having one end thereof connected with the sucking portion at its upper portion and having the other end provided with a connection pipe, an agitator disposed within the sucking portion for scraping up dust, and a channel portion provided in the opening, the joint portion, and the connection pipe for transporting the sucked-up dust therethrough, in which the joint portion is turnable, relative to the sucking portion, in a direction substantially parallel to a surface to be cleaned to such an extent that the longitudinal central axis of the sucking portion and the longitudinal central axis of the connection pipe become substantially parallel to each other.

DESCRIPTION OF THE PREFERRED EMBODIMENTS

Embodiments 1 to 3 of the present invention will be described below with reference to the accompanying drawings.

Embodiment 1

Figure 1:
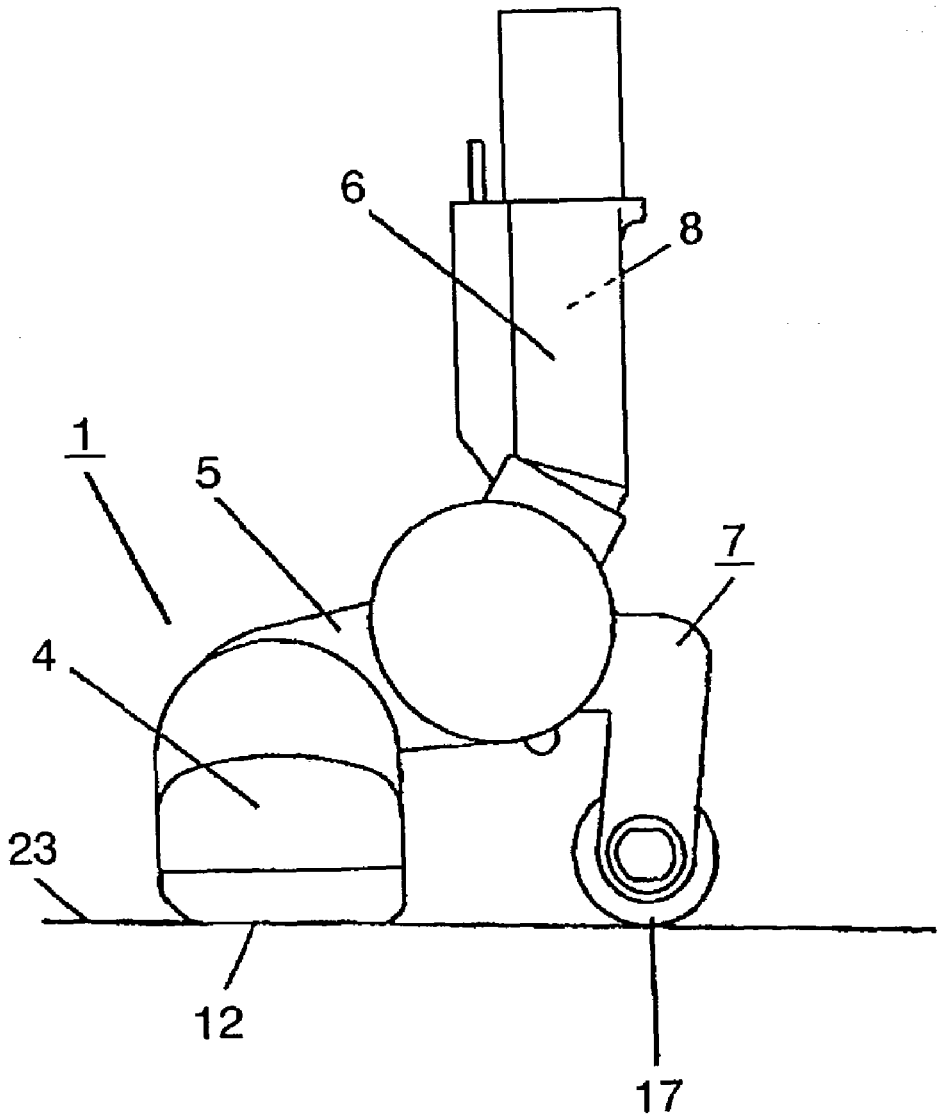
FIG. 1 is a side view of a vacuum-cleaner suction tool showing embodiment 1 of the present invention.

Embodiment 1 will be described with reference to FIG. 1 to FIG. 8. FIG. 1 is a side view of a vacuum-cleaner suction tool.

Sucking portion 4 is provided, on its under side, with opening 12 for sucking up dust. To the upper side of sucking portion 4, one end of joint portion 5 is attached turnably in the direction substantially parallel to a surface 23 to be cleaned. To joint portion 5, supporting portion 7 is attached. Supporting portion 7 is provided with roller 17, which has its surface formed of a soft material such as an elastomer, flexible resin such as polypropylene or vinyl chloride, or a raised blanket and supports joint portion 5 by rolling over surface 23 to be cleaned by being placed in contact with the surface. Joint portion 5 has connection pipe 6 attached to the other end thereof. Incidentally, supporting portion 7 may be attached to connection pipe 6. There is formed channel portion 8 through which dust sucked up at opening 12 is transported to joint portion 5 and further to connection pipe 6.

Figure 2:
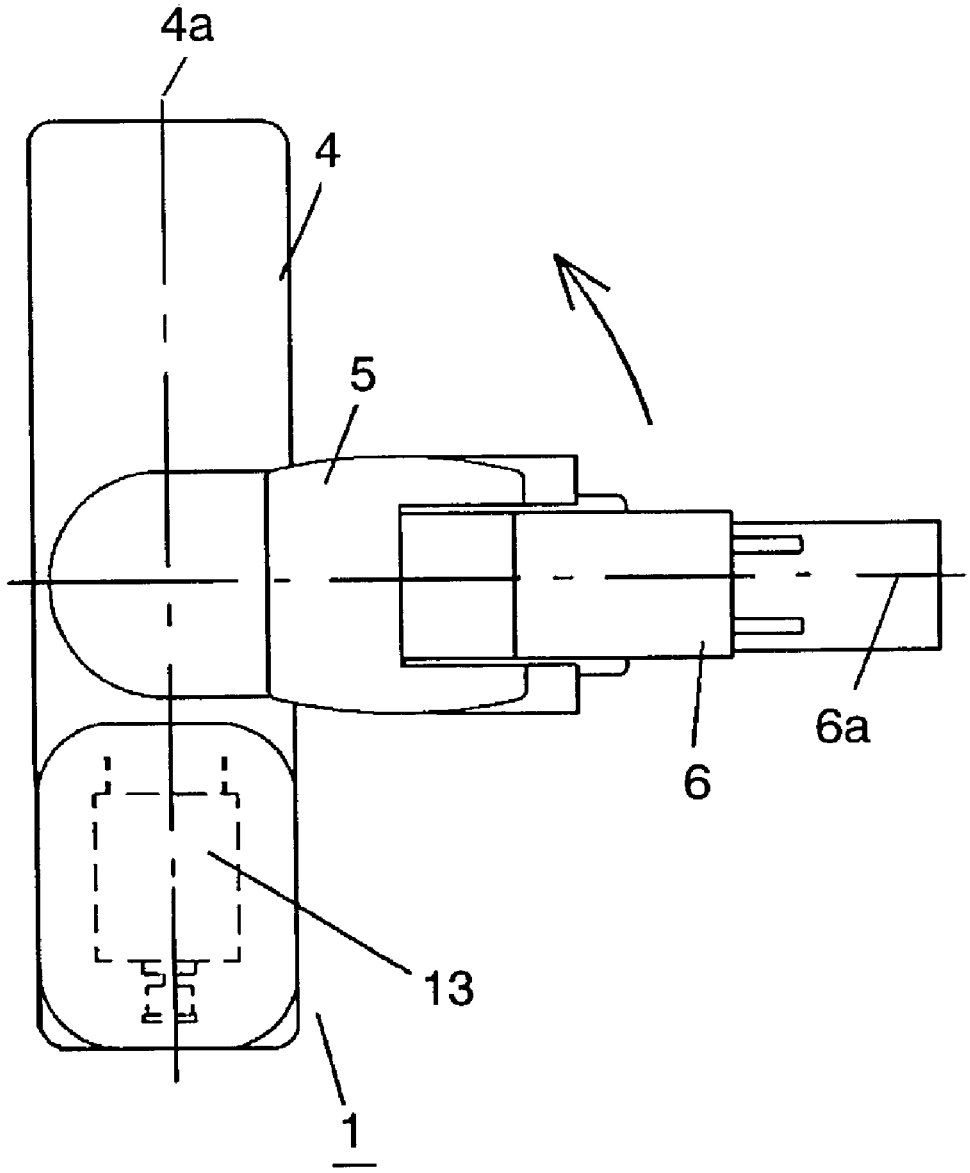
FIG. 2 is a top view of the vacuum-cleaner suction tool.
Figure 3:
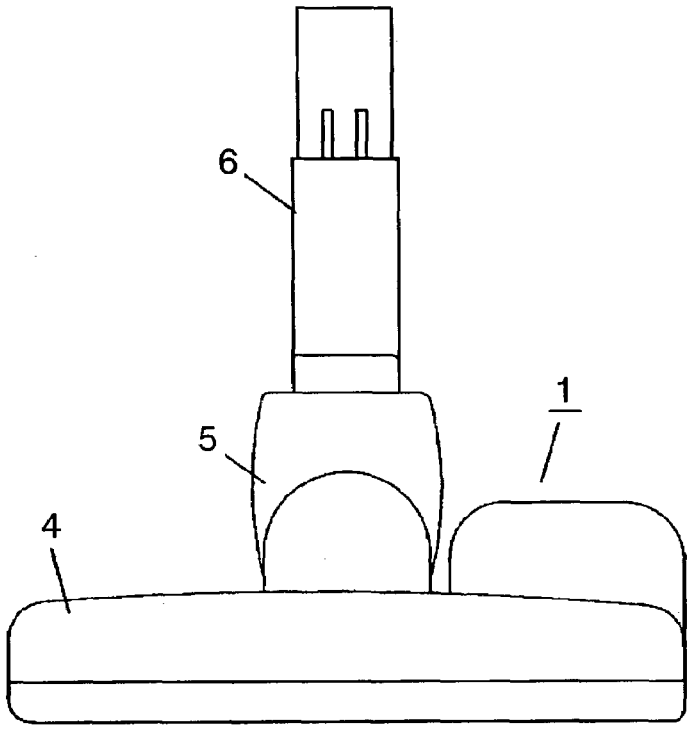
FIG. 3 is a front view of the vacuum-cleaner suction tool.
Figure 4:
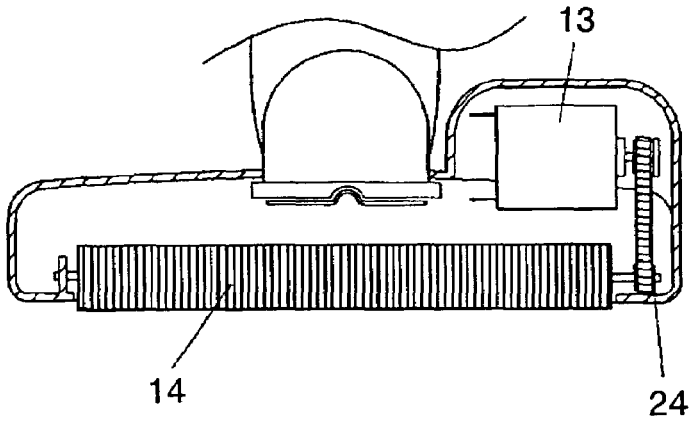
FIG. 4 is an internal structural drawing of the vacuum-cleaner suction tool.

FIG. 2, FIG. 3, and FIG. 4 are a top view, a front view, and an internal structural drawing of the vacuum-cleaner suction tool.

In the portion projecting upwardly from sucking portion 4, there is incorporated electric motor 13. By power of the motor, agitator 14 is rotatively driven via belt 24 so that dust attached to the surface to be cleaned such as a carpet can be forcibly scraped off the surface to be cleaned, and thereby sucking up of dust is performed. Since electric motor 13 is disposed above agitator 14, the width of sucking portion 4, i.e., the size from its front side to rear side, is made small. Further, longitudinal central axis 4*a* of sucking portion 4 and longitudinal central axis 6*a* of connection pipe 6 are adapted to be arranged substantially perpendicular to each other.

Figure 5:
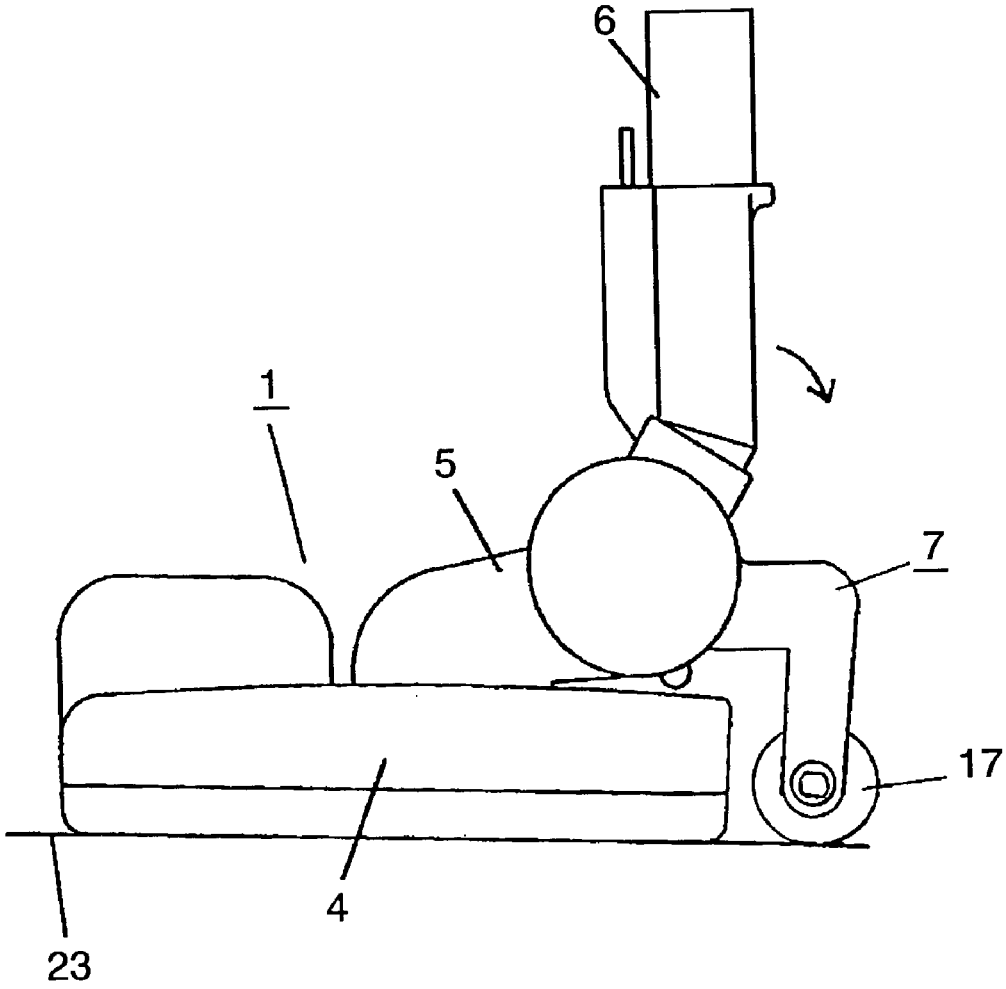
FIG. 5 is another side view of the vacuum-cleaner suction tool.
Figure 6:
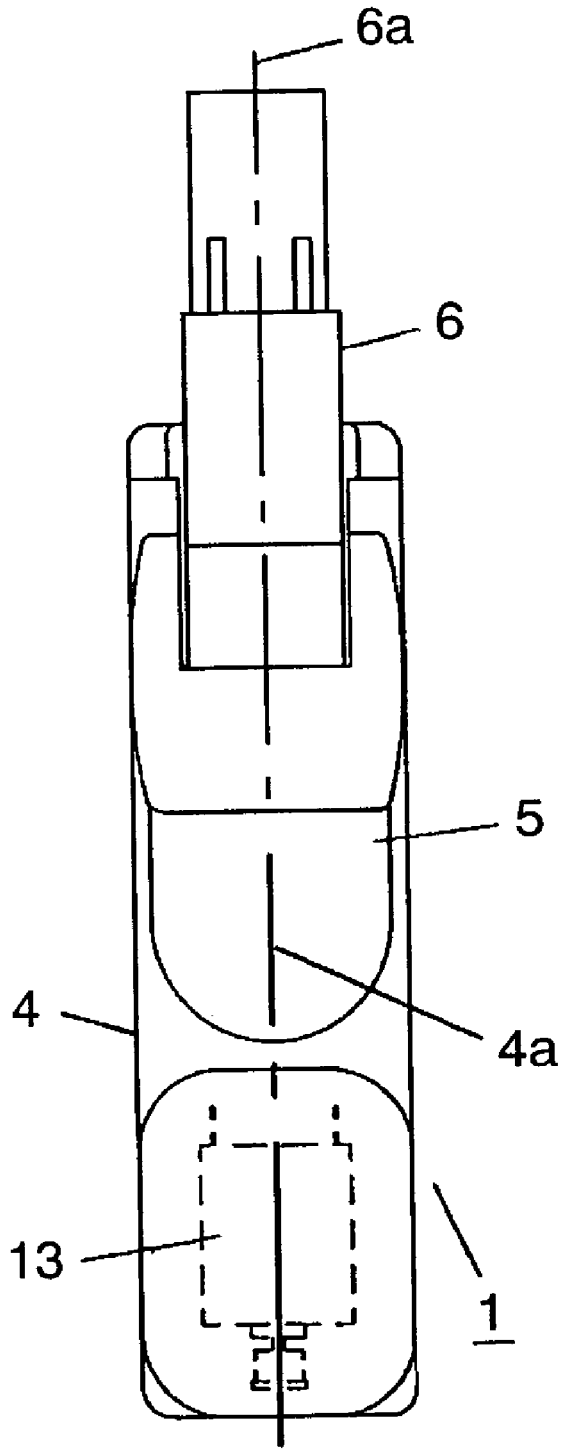
FIG. 6 is another top view of the vacuum-cleaner suction tool.

FIG. 5 and FIG. 6 are a side view and a top view of the vacuum-cleaner suction tool when the joint portion 5 has turned, relative to the sucking portion 4, in a direction substantially parallel to the surface to be cleaned such that the longitudinal central axis 4*a* of the sucking portion 4 and the longitudinal central axis 6*a* of the connection pipe 6 become substantially parallel to each other.

Joint portion 5 is attached to sucking portion 4 turnably, so as to be turnable relative to the sucking portion, in a direction substantially parallel to surface 23 to be cleaned to such an extent that longitudinal central axis 4*a* of sucking portion 4 and longitudinal central axis 6*a* of connection pipe 6 become parallel to each other (become coincident with each other, in the case of embodiment 1). Accordingly, by applying a turning force to joint portion 5 relative to sucking portion 4, it becomes possible to use suction tool 1 in its longitudinal direction (in the direction of longitudinal central axis 4*a* of sucking portion 4). At this time, the outside shape of joint portion 5 and connection pipe 6 falls within the range of the width of sucking portion 4.

Further, when joint portion 5 has turned, relative to sucking portion 4, in the direction substantially parallel to surface 23 to be cleaned such that longitudinal central axis 4*a* of sucking portion 4 and longitudinal central axis 6*a* of connection pipe 6 have become substantially parallel to each other (become coincident, in the case of embodiment 1), supporting portion 7 is then positioned at the rear of sucking portion 4 (in the state where longitudinal central axis 4*a* of sucking portion 4 and longitudinal central axis 6*a* of connection pipe 6 are substantially parallel to each other). Since, in addition, connection pipe 6 can be rotated, relative to joint portion 5, from a position in which longitudinal central axis 6*a* of connection pipe 6 is substantially perpendicular to surface 23 to be cleaned to a position in which longitudinal central axis 6*a* of connection pipe 6 is substantially parallel to surface 23 to be cleaned, suction tool 1 is enabled to reach even into a space that is low and narrow. Thus, a vacuum-cleaner suction tool enhanced in usability and excellent in dust collecting performance in any cleaning attitude can be provided.

Since the rotation at this time is made in a direction away from the side where heavy electric motor 13 is incorporated, sucking portion 4 is allowed to stably keep its position even if the rotating force is applied to joint portion 5 relative to sucking portion 4. Further, since electric motor 13 is disposed above agitator 14, the width of sucking portion 4 measured across its longitudinal central axis 4*a*, in the described condition, can be kept small.

Figure 7:
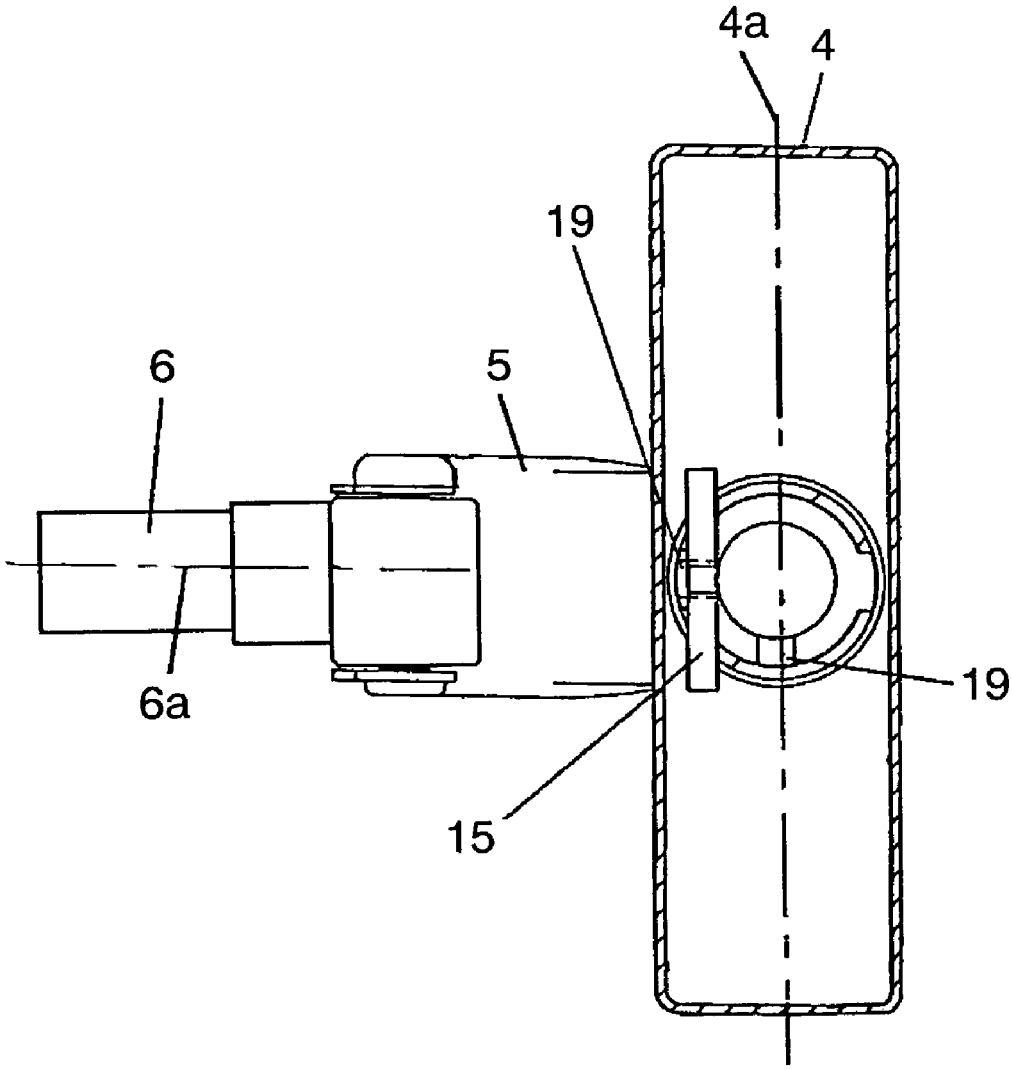
FIG. 7 is an internal structural drawing of the vacuum-cleaner suction tool viewed from its bottom side.
Figure 8:
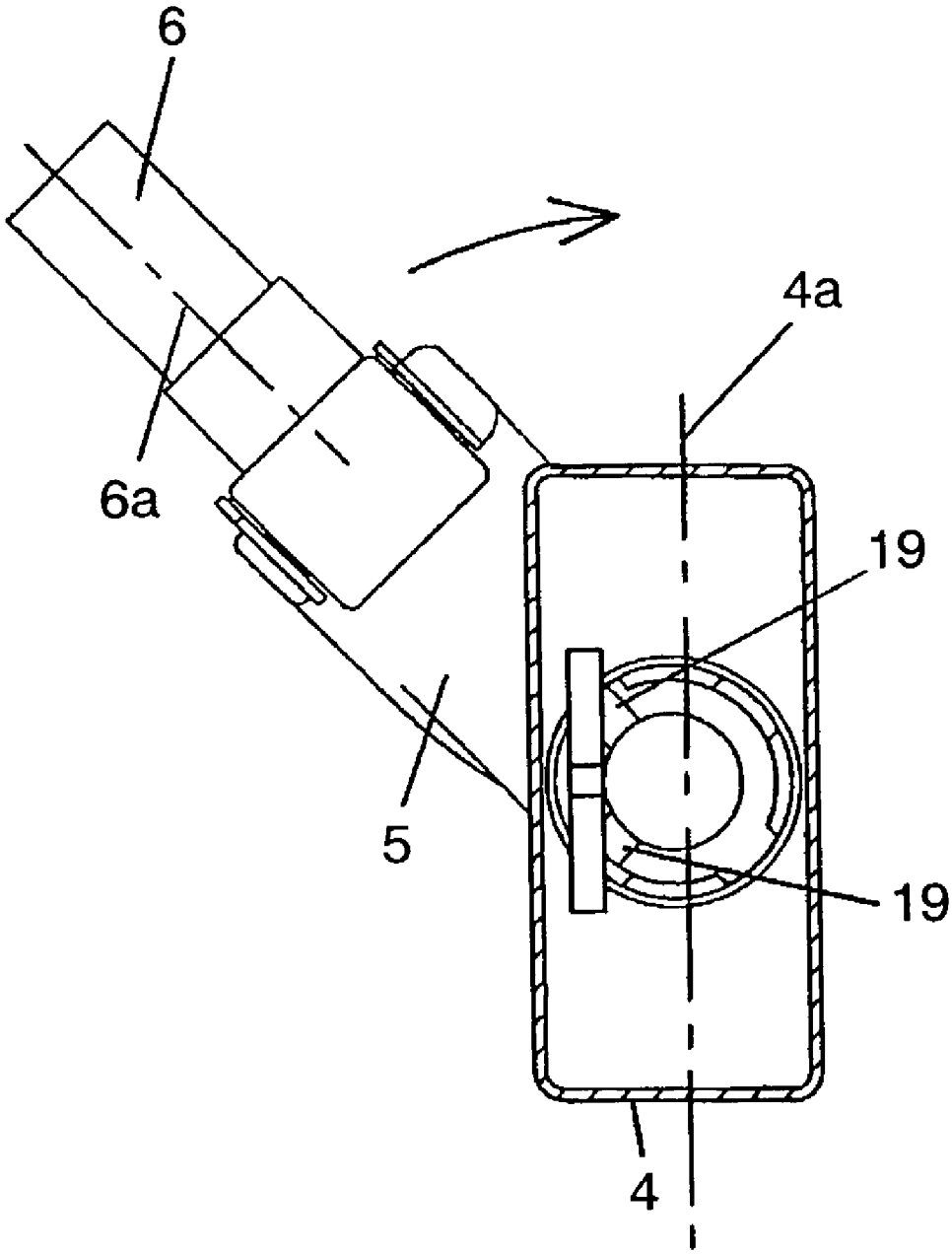
FIG. 8 is another internal structural drawing of the vacuum-cleaner suction tool viewed from its bottom side.

FIG. 7 and FIG. 8 are internal structural drawings of the vacuum-cleaner suction tool viewed from its bottom side.

In two positions, an angular distance of 90° apart from each other, of the portion where joint portion 5 is connected to sucking portion 4, there are provided grooves 19. Further, there is provided retaining member 15 formed of a metallic or plastic plate spring which is adapted to be fitted into one or the other of grooves 19 for suppressing the turning of joint portion 5.

When joint portion 5 is turned, relative to sucking portion 4, in the direction substantially parallel to surface 23 to be cleaned and, thereby, longitudinal central axis 4*a* of sucking portion 4 and longitudinal central axis 6*a* of connection pipe 6 are caused to be substantially parallel to each other (to be coincident with each other, in the case of the present embodiment), or longitudinal central axis 4*a* of sucking portion 4 and longitudinal central axis 6*a* of connection pipe 6 are caused to be substantially perpendicular to each other, retaining member 15 is, then, put into one or the other of grooves 19, so that sucking portion 4 can maintain its present position even when it is subjected to an external force of some degree by collision with furniture or the like while the vacuum cleaner is being used.

Since supporting portion 7 is attached to joint portion 5, sucking portion 4 is prevented from lifting from the floor in the normal cleaning condition in which longitudinal central axis 4*a* of sucking portion 4 and longitudinal central axis 6*a* of connection pipe 6 are substantially perpendicular to each other, so that high usability is obtained. Further, since supporting portion 7 is configured to be positioned on the rear side of sucking portion 4 when joint portion 5 connected with connection pipe 6 is turned, relative to sucking portion 4, in a direction substantially parallel to surface 23 to be cleaned, it is made possible to bring the forward end of sucking portion 4, from left to right, into close contact with wall surfaces. Hence, dust liable to collect at corners can be fully sucked up. Thus, a vacuum-cleaner suction tool providing high usability and excellent dust collecting performance in any cleaning attitude can be provided.

Embodiment 2

Embodiment 2 will now be described with reference to FIG. 9, FIG. 10, and FIG. 11. Components like those used in the above described embodiment 1 will be given like names and reference numerals and description thereof will be omitted.

Figure 9:
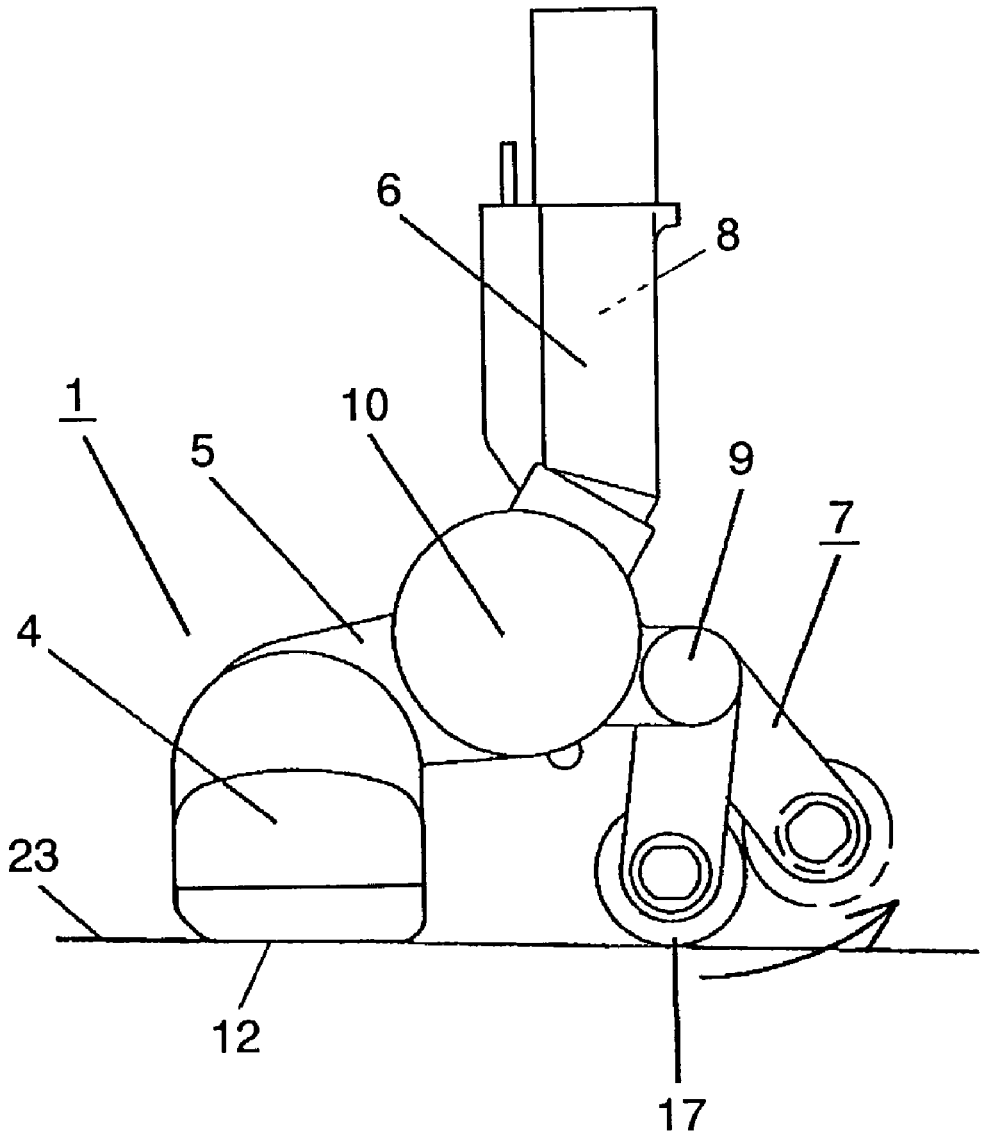
FIG. 9 is a side view of a vacuum-cleaner suction tool showing embodiment 2 of the present invention.
Figure 10:
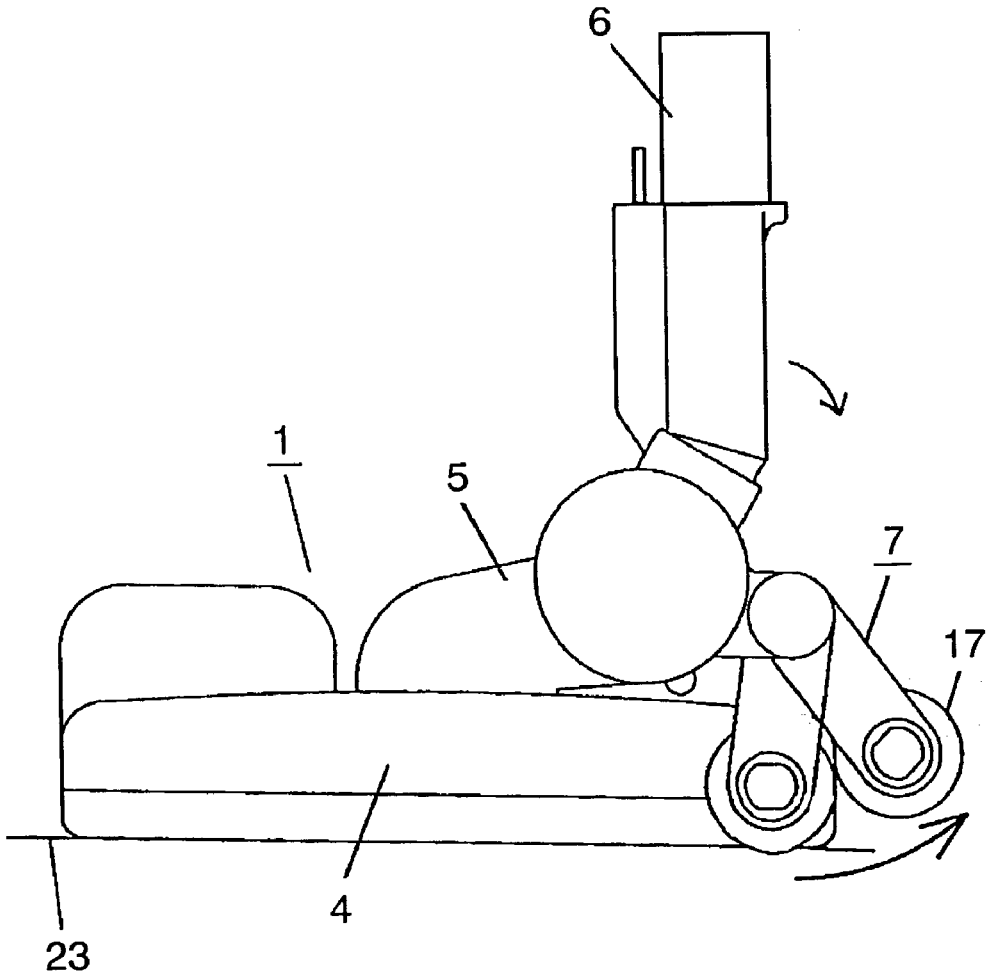
FIG. 10 is another side view showing the vacuum-cleaner suction tool.

Although supporting portion 7 is fixedly attached to one end of joint portion 5 in embodiment 1, supporting portion 7, in embodiment 2, is rotatably attached to one end of joint portion 5 by way of first rotation center 9 as shown in FIG. 9. Supporting portion 7 is further attached to connection pipe 6 by way of second rotation center 10 located at a position closer to sucking portion 4 than first rotation center 9. Incidentally, supporting portion 7 may be attached to connection pipe 6 the same as in embodiment 1. Since roller 17 is positioned closer to the side of sucking portion 4 than first rotation center 9, even if a force is applied to connection pipe 6 to push it down, the front portion of sucking portion 4 is prevented from lifting from the floor due to a rotational movement of supporting portion 7 carried on first rotation center 9.

In the above described configuration, when joint portion 5 has turned, relative to sucking portion 4, in a direction substantially parallel to surface 23 to be cleaned and, thereby, longitudinal central axis 4*a* of sucking portion 4 has become substantially parallel to (coincident with, in the present embodiment) longitudinal central axis 6*a* of connection pipe 6, supporting portion 7 turns in an upward direction from surface 23 to be cleaned so as to be positioned higher than sucking portion 4. In addition, since connection pipe 6 can be turned, relative to joint portion 5, from its state where longitudinal central axis 6*a* of connection pipe 6 is substantially perpendicular to surface 23 to be cleaned to its state where longitudinal central axis 6*a* of connection pipe 6 is substantially parallel to surface 23 to be cleaned, it becomes possible to insert suction tool 1 into a space that is low and narrow. Thus, a vacuum-cleaner suction tool providing high usability and excellent dust collecting performance in any cleaning attitude can be provided.

Figure 11:
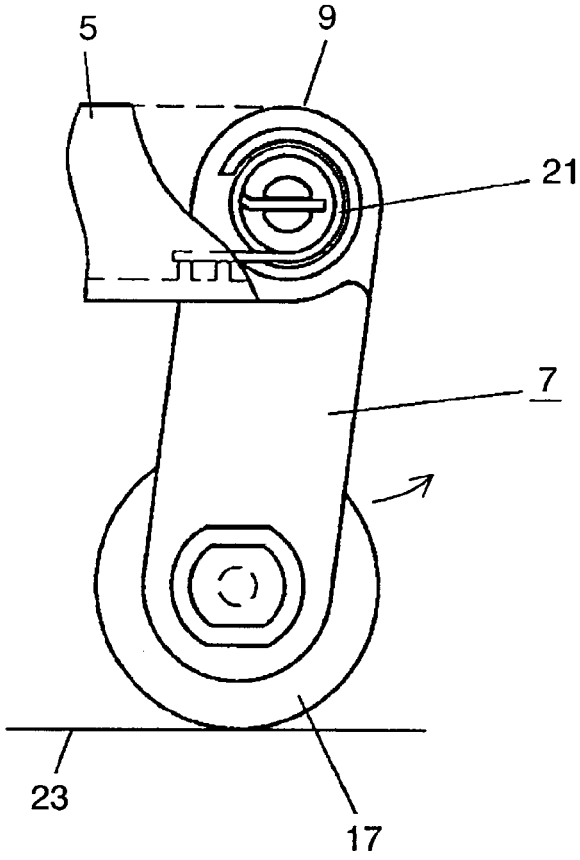
FIG. 11 is a detailed drawing of a sucking portion of the vacuum-cleaner suction tool.

FIG. 11 shows internal structure of the first rotation center to which supporting portion 7 is connected.

There is further provided urging member 21 formed of a spring or the like between supporting portion 7 and joint portion 5. Hence, supporting portion 7 is urged in the direction of sucking portion 4, while it is turnable in an upward direction from surface 23 to be cleaned. Therefore, sucking portion 4 is prevented from lifting from the floor, as described above, due to turning of supporting portion 7 in the normal cleaning condition in which longitudinal central axis 4*a* of sucking portion 4 is substantially perpendicular to longitudinal central axis 6*a* of connection pipe 6, whereby usability of vacuum-cleaner suction tool 1 is enhanced. In addition, when joint portion 5 with connection pipe 6 attached thereto is turned, relative to sucking portion 4, in a direction substantially parallel to surface 23 to be cleaned, supporting portion 7 ensures that sucking portion 4 is secured in position, so that the front end of suction tool 1, from left to right, can be brought into close contact with wall faces, and hence dust liable to collect at corners can be fully sucked up. Thus, a vacuum-cleaner suction tool providing high usability and high dust collecting performance in any cleaning attitude can be provided.

Embodiment 3

Embodiment 3 will be described with reference to FIG. 12 and FIG. 13. Components like those used in embodiments 1 and 2 will be denoted by like reference numerals and description thereof will be omitted.

Embodiment 3 is a vacuum cleaner having the vacuum-cleaner suction tool described in embodiments 1 and 2 connected thereto.

Figure 12:
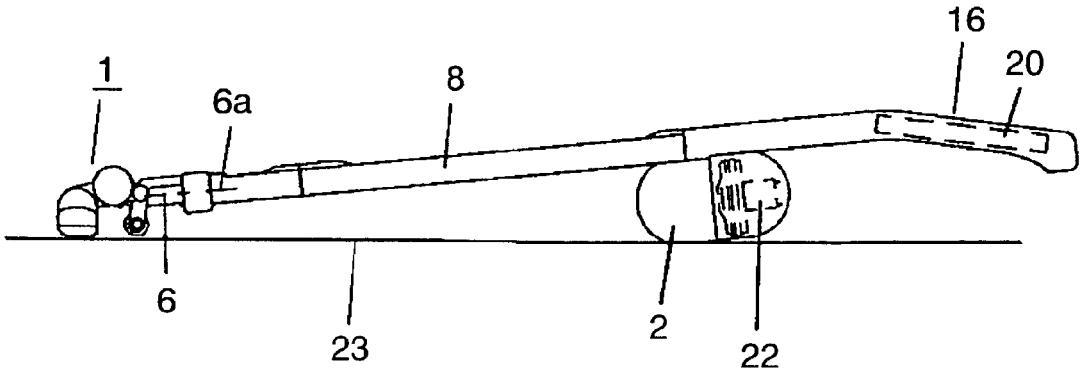
FIG. 12 is a general drawing of a vacuum cleaner showing embodiment 3 of the present invention.
Figure 13:
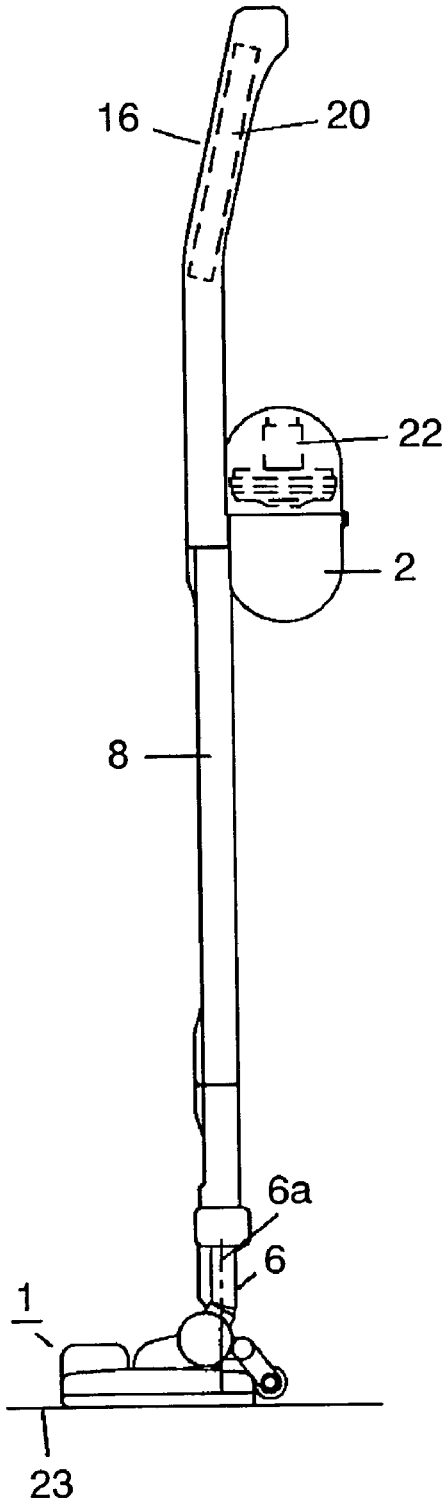
FIG. 13 is another general drawing of the vacuum cleaner.
Figure 14A:
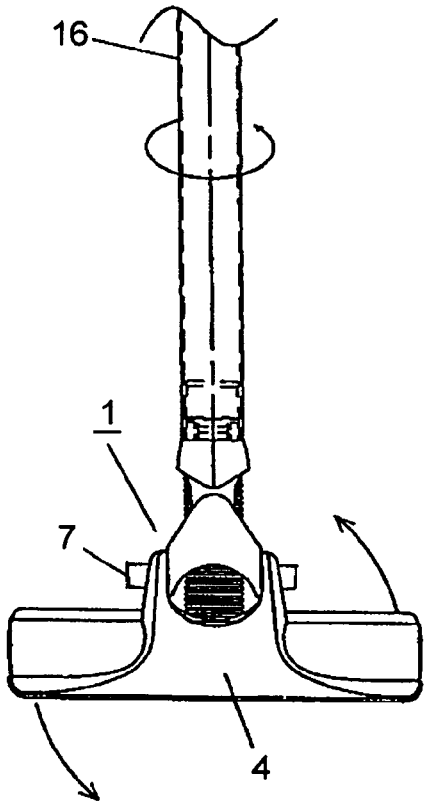
PRIOR ART FIG. 14A
FIG. 14A is a general drawing of a conventional vacuum-cleaner suction tool.
Figure 14B:
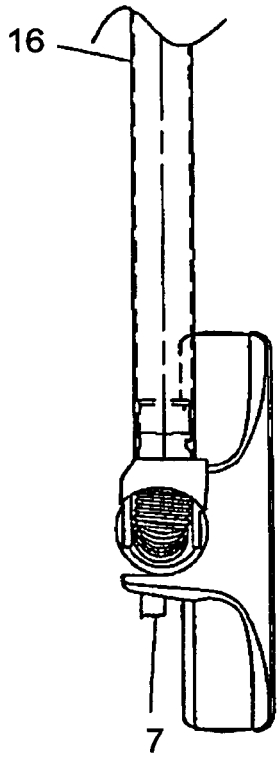
PRIOR ART FIG. 14B
FIG. 14B is another general drawing of the conventional vacuum-cleaner suction tool.

FIG. 12 and FIG. 13 show general drawings of a vacuum cleaner. The vacuum cleaner has dust collecting chamber 2 for collecting dust, channel portion 8 through which sucked-up dust is transported to dust collecting chamber 2, handle portion 16, power supplying battery 20, and electric fan 22 for generating a suction air flow. Electric fan 22 communicates with suction tool 1 through channel portion 8.

In the state where longitudinal central axis 6*a* of connection pipe 6 is substantially parallel to surface 23 to be cleaned, suction tool 1 can be advanced even into a space under a bed or a table as shown in FIG. 12. Hence, it is made possible to fully suck up dust on the surface to be cleaned. When longitudinal central axis 6*a* of connection pipe 6 is turned to a position in which it is substantially perpendicular to surface 23 to be cleaned as shown in FIG. 13, the cleaner in a non-cleaning condition can be conveniently placed or stored, for example, in a small space.

Though the vacuum cleaner of embodiment 3 has been described as a broom-type rechargeable vacuum cleaner, the described configuration is applicable to general vacuum cleaners irrespective of the type of cleaner or power source system.

What is claimed is:

1. A vacuum-cleaner suction tool comprising:

a sucking portion having a first end portion with an opening for sucking up dust on a surface to be cleaned, and a second end portion;

a joint portion having a first end thereof connected with said second end portion of said sucking portion and a second end provided with a connection pipe;

an agitator disposed within said sucking portion for scraping up dust; and a channel portion provided in said opening, said joint portion, and said connection pipe for transporting sucked-up dust therethrough;

wherein said joint portion is turnable, relative to said sucking portion, in a direction substantially parallel to the surface to be cleaned so as to pivot about an axis substantially perpendicular to the surface to be cleaned while a longitudinal central axis of said connection pipe is disposed substantially perpendicular to the surface to be cleaned, and wherein said connection pipe is turnable relative to said joint portion so as to pivot about an axis substantially parallel to the surface to be cleaned, to such an extent that, from a state in which the longitudinal central axis of said connection pipe is substantially perpendicular to the surface to be cleaned and in which a longitudinal central axis of said sucking portion and the longitudinal central axis of said connection pipe are not coincident with each other when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned.

2. The vacuum-cleaner suction tool according to claim 1, wherein said connection pipe is configured to be turnable, relative to said joint portion, from a position in which the longitudinal central axis thereof is substantially parallel to the surface to be cleaned to a position in which the axis is substantially vertical to the surface to be cleaned.

3. A vacuum-cleaner suction tool comprising:

a sucking portion having a first end portion with an opening for sucking up dust on a surface to be cleaned, and a second end portion;

a joint portion having a first end thereof connected with said second end portion of said sucking portion and a second end provided with a connection pipe;

an agitator disposed within said sucking portion for scraping up dust; and a channel portion provided in said opening, said joint portion, and said connection pipe for transporting sucked-up dust therethrough;

wherein said joint portion is turnable, relative to said sucking portion, in a direction substantially parallel to the surface to be cleaned to such an extent that a longitudinal central axis of said sucking portion and a longitudinal central axis of said connection pipe become coincident with each other when seen in top view with said sucking portion disposed on the surface to be cleaned for sucking up dust and with the surface to be cleaned being a substantially horizontal surface;

wherein an electric motor is disposed within said sucking portion for driving said agitator; and wherein said electric motor is disposed above said agitator.

4. The vacuum-cleaner suction tool according to claim 3, wherein said electric motor is disposed substantially at one end in the longitudinal direction of said sucking portion and said joint portion comes to be positioned higher than said sucking portion on a side where said electric motor is not disposed when said joint portion has turned, relative to said sucking portion, in a direction substantially parallel to the surface to be cleaned and the longitudinal central axis of said sucking portion and the longitudinal central axis of said joint portion have become coincident with each other when seen in top view with said sucking portion disposed on the surface to be cleaned for sucking up dust and with the surface to be cleaned being a substantially horizontal surface.

5. The vacuum-cleaner suction tool according to claim 3, further comprising a supporting portion attached to one of said joint portion and said connection pipe for supporting one of said joint portion and said connection pipe by being placed in contact with the surface to be cleaned, wherein said supporting portion is adapted to be positioned on a rear side of said sucking portion when said joint portion has turned, relative to said sucking portion, in a direction substantially horizontal to the surface to be cleaned to such an extent that the longitudinal central axis of said sucking portion and the longitudinal central axis of said connection pipe become substantially parallel to each other.

6. The vacuum-cleaner suction tool according to claim 3, wherein said connection pipe is configured to be turnable, relative to said joint portion, from a position in which the longitudinal central axis thereof is substantially parallel to the surface to be cleaned to a position in which the axis is substantially vertical to the surface to be cleaned.

7. A vacuum-cleaner suction tool comprising:

a sucking portion having a first end portion with an opening for sucking up dust on a surface to be cleaned, and a second end portion;

a joint portion having a first end thereof connected with said second end portion of said sucking portion and a second end provided with a connection pipe;

an agitator disposed within said sucking portion for scraping up dust; and a channel portion provided in said opening, said joint portion, and said connection pipe for transporting sucked-up dust therethrough;

wherein said joint portion is turnable, relative to said sucking portion, in a direction substantially parallel to the surface to be cleaned to such an extent that a longitudinal central axis of said sucking portion and a longitudinal central axis of said connection pipe become coincident with each other when seen in top view with said sucking portion disposed on the surface to be cleaned for sucking up dust and with the surface to be cleaned being a substantially horizontal surface;

wherein a retaining member is provided within the configuration allowing said joint portion to turn, relative to said sucking portion, in a direction substantially parallel to the surface to be cleaned; and wherein said retaining member is configured to disallow said joint portion to turn relative to said sucking portion when a turning force applied to said joint portion is not greater than a predetermined value and to allow said joint portion to turn relative to said sucking portion when the turning force applied to said joint portion is greater than the predetermined value.

8. The vacuum-cleaner suction tool according to claim 1, further comprising a supporting portion attached to one of said joint portion and said connection pipe for supporting one of said joint portion and said connection pipe by being placed in contact with the surface to be cleaned, wherein said supporting portion is adapted to be positioned on a rear side of said sucking portion when said joint portion has turned, relative to said sucking portion, in a direction substantially horizontal to the surface to be cleaned to such an extent that the longitudinal central axis of said sucking portion and the longitudinal central axis of said connection pipe become substantially parallel to each other.

9. The vacuum-cleaner suction tool according to claim 8, wherein said supporting portion includes a part to be contacted with the surface to be cleaned, said part having its periphery covered with an elastomeric resin or raised blanket material.

10. A vacuum-cleaner suction tool comprising:

a sucking portion having an opening for sucking up dust on a surface to be cleaned;

a connection pipe having a longitudinal central axis thereof arranged to be substantially perpendicular to a longitudinal central axis of said sucking portion;

a joint portion for connecting said sucking portion to said connection pipe;

a supporting portion attached to one of said joint portion and said connection pipe for supporting one of said joint portion and said connection pipe by being placed in contact with a surface to be cleaned; and a channel portion provided in said opening, said joint portion, and said connection pipe for transporting sucked-up dust therethrough;

wherein said joint portion is configured to be turnable, relative to said sucking portion, in a direction substantially parallel to the surface to be cleaned while a longitudinal central axis of said connection pipe is disposed substantially perpendicular to the surface to be cleaned;

wherein said supporting portion is configured to be turnable in an upward direction from the surface to be; and wherein said connection pipe is turnable relative to said joint portion so as to pivot about an axis substantially parallel to the surface to be cleaned, to such an extent that, from a state in which the longitudinal central axis of said connection pipe is substantially perpendicular to the surface to be cleaned and in which a longitudinal central axis of said sucking portion and the longitudinal central axis of said connection pipe are not coincident with each other when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned.

11. The vacuum-cleaner suction tool according to claim 10, wherein said supporting portion is adapted to turn upwardly from the surface to be cleaned and come to be positioned higher than said sucking portion when said joint portion is turned, relative to said sucking portion, in a direction substantially parallel to the surface to be cleaned and the longitudinal central axis of said sucking portion and the longitudinal central axis of said connection pipe become substantially parallel to each other.

12. The vacuum-cleaner suction tool according to claim 10, further comprising a retaining member, wherein said retaining member, in the configuration allowing said joint portion to turn, relative to said sucking portion, in a direction substantially parallel to the surface to be cleaned, disallows said joint portion to make a turn when a force applied to said joint portion to make a turn relative to said sucking portion is not greater than a predetermined value and allows said joint portion to turn when the force applied to said joint portion to turn relative to said sucking portion is greater than the predetermined value.

13. The vacuum-cleaner suction tool according to claim 10, wherein said supporting portion is configured to be turnable in an upward direction from the surface to be cleaned, and said vacuum-cleaner suction tool further comprises an urging member for urging said supporting portion toward said sucking portion.

14. A vacuum cleaner having a vacuum-cleaner suction tool, said suction tool comprising:

a sucking portion having a first end portion with an opening for sucking up dust on a surface to be cleaned, and a second end portion;

a joint portion having a first end thereof connected with said second end portion of said sucking portion and having a second end provided with a connection pipe;

an agitator disposed within said sucking portion for scraping up dust; and a channel portion provided in said opening, said joint portion, and said connection pipe for transporting sucked-up dust therethrough, wherein said joint portion is turnable, relative to said sucking portion, in a direction substantially parallel to a surface to be cleaned so as to pivot about an axis substantially perpendicular to the surface to be cleaned while a longitudinal central axis of said connection pipe is disposed substantially perpendicular to the surface to be cleaned, wherein said connection pipe is turnable relative to said joint portion so as to pivot about an axis substantially parallel to the surface to be cleaned, to such an extent that, from a state in which the longitudinal central axis of said connection pipe is substantially perpendicular to the surface to be cleaned and in which a longitudinal central axis of said sucking portion and the longitudinal central axis of said connection pipe are not coincident with each other when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned, and wherein said channel portion of said suction tool is adapted to communicate with an electric fan for generating a suction air flow.

15. A vacuum cleaner having a vacuum-cleaner suction tool, said suction tool comprising:

a sucking portion having an opening for sucking up dust on a surface to be cleaned;

a connection pipe provided such that a longitudinal central axis thereof becomes substantially perpendicular to a longitudinal central axis of said sucking portion;

a joint portion for connecting said sucking portion with said connection pipe;

a supporting portion attached to one of said joint portion and said connection pipe for supporting one of said joint portion and said connection pipe by being placed in contact with a surface to be cleaned; and a channel portion provided in said opening, said joint portion, and said connection pipe for transporting the sucked-up dust therethrough, wherein said joint portion is turnable, relative to said sucking portion, in a direction substantially parallel to a surface to be cleaned so as to pivot about an axis substantially perpendicular to the surface to be cleaned while a longitudinal central axis of said connection pipe is disposed substantially perpendicular to the surface to be cleaned, and wherein said connection pipe is turnable relative to said joint portion so as to pivot about an axis substantially parallel to the surface to be cleaned, to such an extent that, from a state in which the longitudinal central axis of said connection pipe is substantially perpendicular to the surface to be cleaned and in which a longitudinal central axis of said sucking portion and the longitudinal central axis of said connection pipe are not coincident with each other when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned, wherein said supporting portion is turnable in an upward direction from the surface to be cleaned, and wherein said channel portion of said suction tool is adapted to communicate with an electric fan for generating a suction air flow.

16. A vacuum-cleaner suction tool comprising:

a sucking portion having a first end portion with an opening for sucking up dust on a surface to be cleaned, and a second end portion;

a joint portion having a first end thereof connected with said second end portion of said sucking portion, and a second end provided with a connection pipe;

an agitator disposed within said sucking portion for scraping up dust; and a channel portion provided in said opening, said joint portion, and said connection pipe for transporting sucked-up dust therethrough, wherein said joint portion is turnable, relative to said sucking portion, in a direction substantially parallel to the surface to be cleaned so as to pivot about an axis substantially perpendicular to the surface to be cleaned while a longitudinal central axis of said connection pipe is disposed substantially perpendicular to the surface to be cleaned, and wherein said connection pipe is turnable relative to said joint portion so as to pivot about an axis substantially parallel to the surface to be cleaned, such that, from a state in which the longitudinal central axis of said connection pipe is substantially perpendicular to the surface to be cleaned and in which a longitudinal central axis of said sucking portion and the longitudinal central axis of said connection pipe are not coincident with each other, and such that a width of said connection pipe falls within the range of a width of said sucking portion, when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned.

17. A vacuum cleaner having a vacuum cleaner suction tool, said suction tool comprising:

a sucking portion having a first end portion with an opening for sucking up dust on a surface to be cleaned, and a second end portion;

a joint portion having a first end thereof connected with said second end portion of said sucking portion and a second end provided with a connection pipe;

an agitator disposed within said sucking portion for scraping up dust; and a channel portion provided in said opening, said joint portion, and said connection pipe, said channel portion being arranged to communicate with an electric blower which generates air suction, and said channel portion being arranged for transporting sucked-up dust therethrough, wherein wherein said joint portion is turnable, relative to said sucking portion, in a direction substantially parallel to the surface to be cleaned so as to pivot about an axis substantially perpendicular to the surface to be cleaned while a longitudinal central axis of said connection pipe is disposed substantially perpendicular to the surface to be cleaned, and wherein said connection pipe is turnable relative to said joint portion so as to pivot about an axis substantially parallel to the surface to be cleaned, such that, from a state in which the longitudinal central axis of said connection pipe is substantially perpendicular to the surface to be cleaned and in which a longitudinal central axis of said sucking portion and the longitudinal central axis of said connection pipe become are not coincident with each other, and such that a width of said connection pipe falls within the range of a width of said sucking portion when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned.

18. A vacuum-cleaner suction tool comprising:

a sucking portion having an opening for sucking up dust on a surface to be cleaned;

a joint portion having a first end thereof connected with said sucking portion at an upper portion thereof and a second end provided with a connection pipe;

an agitator disposed within said sucking portion for scraping up dust;

a channel portion provided in said opening, said joint portion, and said connection pipe for transporting sucked-up dust therethrough, wherein said joint portion is turnable, relative to said sucking portion, in a direction substantially parallel to the surface to be cleaned to such an extent that a longitudinal central axis of said sucking portion and a longitudinal central axis of said connection pipe become substantially parallel to each other; and an electric motor within said sucking portion for driving said agitator, wherein said electric motor is disposed above said agitator.

19. The vacuum-cleaner suction tool according to claim 18, wherein said electric motor is disposed substantially at one end in the longitudinal direction of said sucking portion and said joint portion comes to be positioned higher than said sucking portion on a side where said electric motor is not disposed when said joint portion has turned, relative to said sucking portion, in a direction substantially parallel to the surface to be cleaned and the longitudinal central axis of said sucking portion and the longitudinal central axis of said joint portion have become substantially parallel to each other.

20. The vacuum-cleaner suction tool according to claim 18, further comprising a supporting portion attached to one of said joint portion and said connection pipe for supporting one of said joint portion and said connection pipe by being placed in contact with the surface to be cleaned, wherein said supporting portion is adapted to be positioned on a rear side of said sucking portion when said joint portion has turned, relative to said sucking portion, in a direction substantially parallel to the surface to be cleaned to such an extent that the longitudinal central axis of said sucking portion and the longitudinal central axis of said connection pipe become coincident with each other when seen in top view with said sucking portion disposed on the surface to be cleaned for sucking up dust and with the surface to be cleaned being a substantially horizontal surface.

21. The vacuum-cleaner suction tool according to claim 18, wherein said connection pipe is configured to be turnable, relative to said joint portion, from a position in which the longitudinal central axis thereof is substantially parallel to the surface to be cleaned to a position in which the axis is substantially perpendicular to the surface to be cleaned.

22. A vacuum-cleaner suction tool comprising:

a sucking portion having an opening for sucking up dust on a surface to be cleaned;

a joint portion having a first end thereof connected with said sucking portion at an upper portion thereof and a second end provided with a connection pipe;

an agitator disposed within said sucking portion for scraping up dust;

a channel portion provided in said opening, said joint portion, and said connection pipe for transporting sucked-up dust therethrough, wherein said joint portion is turnable, relative to said sucking portion, in a direction substantially parallel to the surface to be cleaned to such an extent that a longitudinal central axis of said sucking portion and a longitudinal central axis of said connection pipe become substantially parallel to each other; and a retaining member within the configuration allowing said joint portion to turn, relative to said sucking portion, in a direction substantially parallel to the surface to be cleaned, said retaining member disallowing said joint portion to turn relative to said sucking portion when a turning force applied to said joint portion is not greater than a predetermined value and allowing said joint portion to turn relative to said sucking portion when the turning force applied to said joint portion is greater than the predetermined value.

23. A vacuum-cleaner suction tool comprising:

a sucking portion having an opening for sucking up dust on a surface to be cleaned;

a joint portion having a first end thereof connected with said sucking portion at an upper portion thereof and a second end provided with a connection pipe;

an agitator disposed within said sucking portion for scraping up dust;

a channel portion provided in said opening, said joint portion, and said connection pipe for transporting sucked-up dust therethrough, wherein said joint portion is turnable, relative to said sucking portion, in a direction substantially parallel to the surface to be cleaned, so as to pivot about an axis substantially perpendicular to the surface to be cleaned, to such an extent that a longitudinal central axis of said sucking portion and a longitudinal central axis of said connection pipe become substantially parallel to each other; and a supporting portion attached to one of said joint portion and said connection pipe for supporting one of said joint portion and said connection pipe by being placed in contact with the surface to be cleaned, wherein said supporting portion is adapted to be positioned on a rear side of said sucking portion when said joint portion has turned, relative to said sucking portion, in a direction substantially parallel to the surface to be cleaned to such an extent that the longitudinal central axis of said sucking portion and the longitudinal central axis of said connection pipe become substantially parallel to each other; and wherein said connection pipe is turnable relative to said joint portion so as to pivot about an axis substantially parallel to the surface to be cleaned, to such an extent that, from a state in which the longitudinal central axis of said connection pipe is substantially perpendicular to the surface to be cleaned and in which a longitudinal central axis of said sucking portion and the longitudinal central axis of said connection pipe are not coincident with each other when seen in top view with said sucking portion disposed on the surface to be cleaned for sucking up dust and with the surface to be cleaned being a substantially horizontal surface, the longitudinal central axis of said sucking portion and the longitudinal central axis of said connection pipe can be made coincident with each other when seen in top view by pivoting said joint portion about the axis that is substantially perpendicular to the surface to be cleaned and pivoting said connection pipe about the axis substantially parallel to the surface to be cleaned.

24. The vacuum-cleaner suction tool according to claim 23, wherein said supporting portion includes a part to be contacted with the surface to be cleaned, said part having its periphery covered with an elastomeric resin or raised blanket material.

* * * * *

UNITED STATES PATENT AND TRADEMARK OFFICE

CERTIFICATE OF CORRECTION

PATENT NO. : 7,383,608 B2
APPLICATION NO. : 10/421733
DATED : June 10, 2008
INVENTOR(S) : Toru Odachi et al.

It is certified that error appears in the above-identified patent and that said Letters Patent is hereby corrected as shown below:

In column 7, claim 8, lines 49-61, please change

"The vacuum-cleaner suction tool according to claim 2, further comprising a supporting portion attached to one of said joint portion and said connection pipe for supporting one of said joint portion and said connection pipe by being placed in contact with the surface to be cleaned, wherein said supporting portion is adapted to be positioned on a rear side of said sucking portion when said joint portion has turned, relative to said sucking portion, in a direction substantially parallel to the surface to be cleaned to such an extent that the longitudinal central axis of said sucking portion and the longitudinal central axis of said connection pipe become coincident with each other when seen in top view with said sucking portion disposed on the surface to be cleaned for sucking up dust and with the surface to be cleaned being a substantially horizontal surface." to --A vacuum-cleaner suction tool comprising:

a sucking portion having a first end portion with an opening for sucking up dust on a surface to be cleaned, and a second end portion;

a joint portion having a first end thereof connected with said second end portion of said sucking portion and a second end provided with a connection pipe;

It is certified that error appears in the above-identified patent and that said Letters Patent is hereby corrected as shown below:

an agitator disposed within said sucking portion for scraping up dust; and a channel portion provided in said opening, said joint portion, and said connection pipe for transporting sucked-up dust therethrough;

wherein said joint portion is turnable, relative to said sucking portion, in a direction substantially parallel to the surface to be cleaned to such an extent that a longitudinal central axis of said sucking portion and a longitudinal central axis of said connection pipe become coincident with each other when seen in top view with said sucking portion disposed on the surface to be cleaned for sucking up dust and with the surface to be cleaned being a substantially horizontal surface;

wherein a supporting portion is attached to one of said joint portion and said connection pipe for supporting one of said joint portion and said connection pipe by being placed in contact with the surface to be cleaned; and

UNITED STATES PATENT AND TRADEMARK OFFICE

CERTIFICATE OF CORRECTION

PATENT NO. : 7,383,608 B2
APPLICATION NO. : 10/421733
DATED : June 10, 2008
INVENTOR(S) : Toru Odachi et al.

It is certified that error appears in the above-identified patent and that said Letters Patent is hereby corrected as shown below:

wherein said supporting portion is adapted to be positioned on a rear side of said sucking portion when said joint portion has turned, relative to said sucking portion, in a direction substantially parallel to the surface to be cleaned to such an extent that the longitudinal central axis of said sucking portion and the longitudinal central axis of said connection pipe become coincident with each other when seen in top view with said sucking portion disposed on the surface to be cleaned for sucking up dust and with the surface to be cleaned being a substantially horizontal surface.--.

Signed and Sealed this

Fourth Day of November, 2008

JON W. DUDAS
*Director of the United States Patent and Trademark Office*